US012253324B2

(12) United States Patent
Bender et al.

(10) Patent No.: US 12,253,324 B2
(45) Date of Patent: Mar. 18, 2025

(54) FIREARM ACTION MECHANISM

(71) Applicant: In Ovation LLC, Vadnais Heights, MN (US)

(72) Inventors: Terrence Dwight Bender, Minneapolis, MN (US); Benjamin P. Peterson, East Bethel, MN (US)

(73) Assignee: In Ovation LLC, Vadnais Heights, MN (US)

( * ) Notice: Subject to any disclaimer, the term of this patent is extended or adjusted under 35 U.S.C. 154(b) by 35 days.

(21) Appl. No.: 18/118,698

(22) Filed: Mar. 7, 2023

(65) Prior Publication Data

US 2023/0392888 A1 Dec. 7, 2023

Related U.S. Application Data

(60) Provisional application No. 63/317,513, filed on Mar. 7, 2022.

(51) Int. Cl.
*F41A 5/28* (2006.01)

(52) U.S. Cl.
CPC ..... *F41A 5/28* (2013.01)

(58) Field of Classification Search
CPC ..... F41A 5/00; F41A 5/26; F41A 5/28; F41C 27/22
See application file for complete search history.

(56) References Cited

U.S. PATENT DOCUMENTS 813,802 A 2/1906 Johnson
1,924,692 A 8/1933 Loomis
2,779,249 A 1/1957 Saetter-Lassen
2,836,918 A 6/1958 Pula et al.
2,951,424 A 9/1960 Stoner
3,198,076 A 8/1965 Stoner
3,387,400 A 6/1968 Badali et al.
3,776,095 A 12/1973 Atchisson
4,022,105 A 5/1977 White
4,057,003 A 11/1977 Atchisson
4,389,919 A 6/1983 Kast et al.
4,461,203 A 7/1984 Jawdat
4,579,034 A 4/1986 Holloway
4,920,855 A 5/1990 Waters
4,930,399 A 6/1990 Trevor
5,117,735 A 6/1992 Flashkes
5,770,814 A 6/1998 Ealovega
5,909,002 A 6/1999 Atchisson
6,091,944 A 7/2000 Friend
(Continued)

OTHER PUBLICATIONS

Slowik, Max, The Inscrutable AK-107 and AK-108, Website, Nov. 18, 2011, Guns.com.

*Primary Examiner* — Joshua E Freeman
(74) *Attorney, Agent, or Firm* — Laabs Intellectual Property

(57) ABSTRACT

In some embodiments, a firearm action mechanism comprises a bolt assembly, a counterweight and a connector engaged with the bolt assembly and with the counterweight. The bolt assembly is arranged to move along a first axis. The counterweight is arranged to move along a second axis. A direction of movement of the bolt assembly is different from a direction of movement of the counterweight. In some embodiments, the movement of the counterweight is opposite the movement of the bolt assembly. In some embodiments, the connector comprises a roller.

19 Claims, 8 Drawing Sheets

(56) References Cited

U.S. PATENT DOCUMENTS

| | | | | |
|---|---|---|---|---|
| 6,189,253 | B1 | 2/2001 | Knight et al. | |
| 6,240,670 | B1 | 6/2001 | Findlay | |
| 6,293,040 | B1 | 9/2001 | Luth | |
| 6,484,430 | B1 | 11/2002 | Robinson et al. | |
| 6,609,319 | B1 | 8/2003 | Olson | |
| 6,971,202 | B2 | 12/2005 | Bender | |
| 7,895,930 | B2 * | 3/2011 | Fisk | F41A 25/08 89/1.13 |
| 8,297,174 | B1 * | 10/2012 | Russell | F41A 25/12 89/44.01 |
| 8,677,664 | B2 | 3/2014 | Caravaggi et al. | |
| 8,800,424 | B2 | 8/2014 | Gangl et al. | |
| 8,899,141 | B2 | 12/2014 | Reynolds et al. | |
| 9,103,611 | B2 | 8/2015 | Neitzling | |
| 9,228,786 | B2 | 1/2016 | Sullivan et al. | |
| 9,297,609 | B2 | 3/2016 | Burt | |
| 9,459,060 | B2 | 10/2016 | Langevin et al. | |
| 10,001,336 | B2 | 6/2018 | Brown et al. | |
| 10,088,268 | B2 | 10/2018 | Hewes et al. | |
| 10,113,829 | B2 | 10/2018 | Nachefski et al. | |
| 10,488,136 | B2 | 11/2019 | Sullivan et al. | |
| 10,545,005 | B2 | 1/2020 | Bender | |
| 10,704,854 | B1 | 7/2020 | Bender | |
| 10,775,121 | B2 | 9/2020 | Bender | |
| 10,852,084 | B2 * | 12/2020 | Gregorich | F41A 3/66 |
| 10,890,392 | B1 * | 1/2021 | Pederson | F41A 3/86 |
| 2008/0000128 | A1 | 1/2008 | Newman | |
| 2012/0180354 | A1 | 7/2012 | Sullivan et al. | |
| 2013/0118343 | A1 | 5/2013 | Hirt | |
| 2014/0102287 | A1 | 4/2014 | Jebsen et al. | |
| 2015/0338178 | A1 | 11/2015 | Neitzling | |
| 2015/0377583 | A1 * | 12/2015 | Furusho | F41A 3/56 42/1.06 |
| 2016/0370135 | A1 | 12/2016 | Plumb et al. | |
| 2017/0115078 | A1 | 4/2017 | Plumb | |
| 2017/0205165 | A1 * | 7/2017 | Furusho | F41A 5/10 |
| 2017/0299323 | A1 | 10/2017 | Nachefski et al. | |
| 2018/0080732 | A1 | 3/2018 | Brown et al. | |

* cited by examiner

FIREARM ACTION MECHANISM

CROSS-REFERENCE TO RELATED APPLICATIONS

This application claims the benefit of U.S. Patent Application No. 63/317,513, filed Mar. 7, 2022, the entire content of which is hereby incorporated herein by reference.

BACKGROUND OF THE INVENTION

This invention relates generally to firearms and more specifically to firearm action mechanisms.

Firearms are generally known in the art. Many firearms are arranged to accept cartridges that include a bullet and propellant. When the propellant is ignited, expanding gasses launch the bullet from the firearm. Some firearms are arranged to utilize the expanding gasses to cycle the firearm action mechanism.

Recoil and reactive forces from firing a round can cause difficulties in accuracy, especially under repeated or sustained firing. There remains a need for compact and lightweight firearm designs that exhibit better balance and reduced recoil.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a firearm action mechanism comprises a bolt assembly, a counterweight and a connector engaged with the bolt assembly and with the counterweight. The bolt assembly is arranged to move along a first axis. The counterweight is arranged to move along a second axis. A direction of movement of the bolt assembly is different from a direction of movement of the counterweight. In some embodiments, the movement of the counterweight is opposite the movement of the bolt assembly. In some embodiments, the connector comprises a roller. In some embodiments, the firearm action mechanism comprises a gas block comprising a fluid passageway in fluid communication with the counterweight. In some embodiments, the gas block comprises a cylinder and the counterweight comprises a piston oriented in the cylinder. In some embodiments, the fluid passageway is in fluid communication with the bolt assembly, and pressure in the fluid passageway biases the bolt assembly in a first direction and biases the counterweight in a second direction.

In some embodiments, a firearm action mechanism comprises a bolt assembly arranged to move along a first axis, a counterweight arranged to move along a second axis, and a connector engaged with the bolt assembly and with the counterweight. In some embodiments, the first axis is parallel to the second axis. In some embodiments, the connector comprises a roller. In some embodiments, the counterweight is arranged to move in a direction opposite to the bolt assembly. In some embodiments, the counterweight is arranged to move equal-but-opposite to the bolt assembly. In some embodiments, the roller comprises a gear. In some embodiments, the bolt assembly comprises a first rack engaged with the gear and the counterweight comprises a second rack engaged with the gear.

In some embodiments, a firearm comprises a housing comprising a first guide and a second guide, a bolt assembly arranged to move in the first guide and a counterweight arranged to move in the second guide. A connector is engaged with the bolt assembly and with the counterweight, and a direction of movement of the bolt assembly is different from a direction of movement of the counterweight. In some embodiments, the direction of movement of the bolt assembly is opposite the direction of movement of the counterweight.

In some embodiments, a housing comprises a cavity comprising a first portion, a second portion and a third portion. The first portion comprises the first guide, the second portion comprises the second guide and the connector is oriented in the third portion. In some embodiments, the housing comprises a servicing aperture and a cover. The servicing aperture is in fluid communication with the third portion and the cover is arranged to close the servicing aperture. In some embodiments, the connector is sized to pass through the servicing aperture.

In some embodiments, the connector is arranged to rotate with respect to the housing.

In some embodiments, a housing comprises a first guide for the bolt assembly and a second guide for the counterweight. In some embodiments, the roller is supported by the housing. In some embodiments, a rotation axis of the roller is orthogonal to the first axis. In some embodiments, the rotation axis is positioned between the first axis and the second axis. In some embodiments, a roller assembly comprises the roller, a first roller bearing and a second roller bearing. In some embodiments, the receiver comprises an aperture and a cover, and the roller assembly can be removed through the aperture. In some embodiments, the housing comprises an upper receiver arranged for use with an AR15/M16 lower receiver.

In some embodiments, the moving mass of the bolt assembly is relatively equal to the moving mass of the counterweight assembly.

In some embodiments, firearm action mechanism comprises a first piston arranged to move in a first direction and a second piston arranged to move in a second direction. In some embodiments, the first piston moves in a direction opposite to the second piston.

In some embodiments, a gas block comprises a first cylinder and a second cylinder. In some embodiments, the first piston is in the first cylinder and the second piston is in the second cylinder. In some embodiments, the second piston is arranged to exit the second cylinder during cycling of the action mechanism.

In some embodiments, the first piston is arranged to move the bolt assembly. In some embodiments, the second piston is arranged to move the counterweight. In some embodiments, the second piston comprises a connecting rod attached to the counterweight.

In some embodiments, a recoil spring is supported by a counterweight assembly. In some embodiments, a recoil spring is supported by the connecting rod.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

FIG. 5B shows a cross-sectional view.

FIG. 6B shows a cross-sectional view.

DETAILED DESCRIPTION OF THE INVENTION

Figure 1:
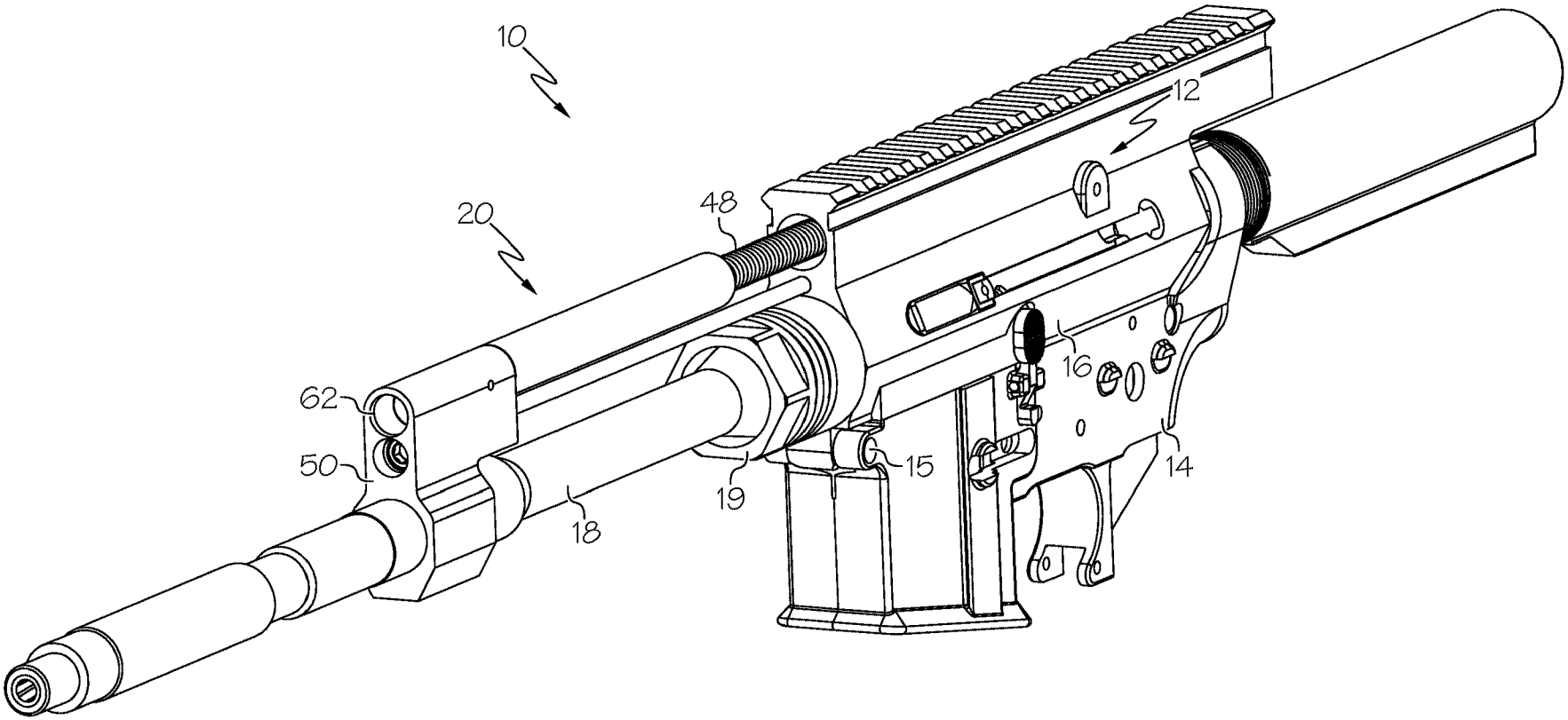
FIG. 1 shows an embodiment of a firearm.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a firearm 10. In some embodiments, the firearm 10 comprises a receiver 12 arranged to contain and/or receive parts of the firearm 10. In some embodiments, the firearm 10 comprises a barrel 18. In some embodiments, the barrel 18 is attached to the receiver 12. In some embodiments, the barrel 18 is fastened to the receiver 12 with a barrel nut 19.

In some embodiments, the receiver 12 comprises a first portion 14 attached to a second portion 16. In some embodiments, the first portion 14 comprises a lower receiver 14. In some embodiments, the first portion 14 comprises a standard AR15/M16 lower receiver. In some embodiments, the lower receiver 14 is arranged to support a fire control mechanism, for example as disclosed in U.S. Pat. No. 8,572,880. In some embodiments, the lower receiver 14 is arranged to support a safety mechanism.

In some embodiments, the second portion 16 comprises an upper receiver 16. In some embodiments, the receiver 12 comprises a hinge 15, and the lower receiver 14 is moveable with respect to the upper receiver 16 about an axis of the hinge 15. In some embodiments, the hinge 15 comprises a takedown and pivot pin. In some embodiments, an upper receiver 16 is arranged to be used with a standard AR15/M16 lower receiver.

Figure 2:
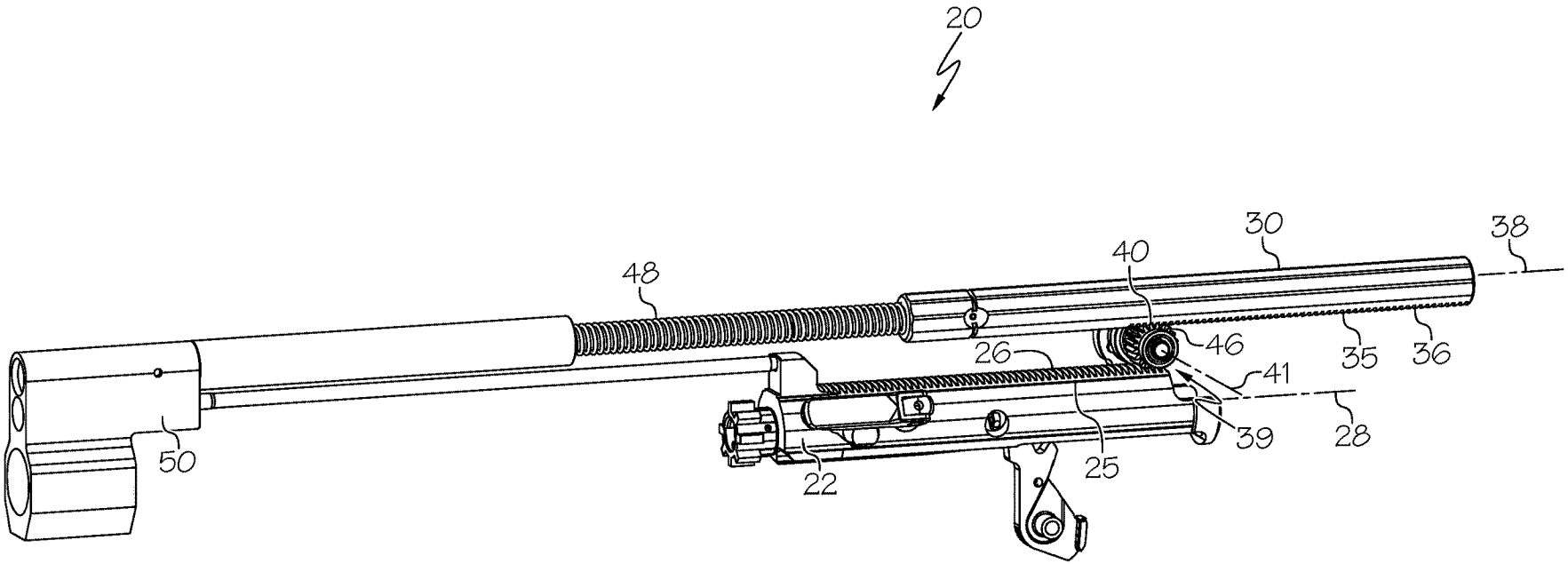
FIG. 2 shows an embodiment of an action mechanism.
Figure 3A:
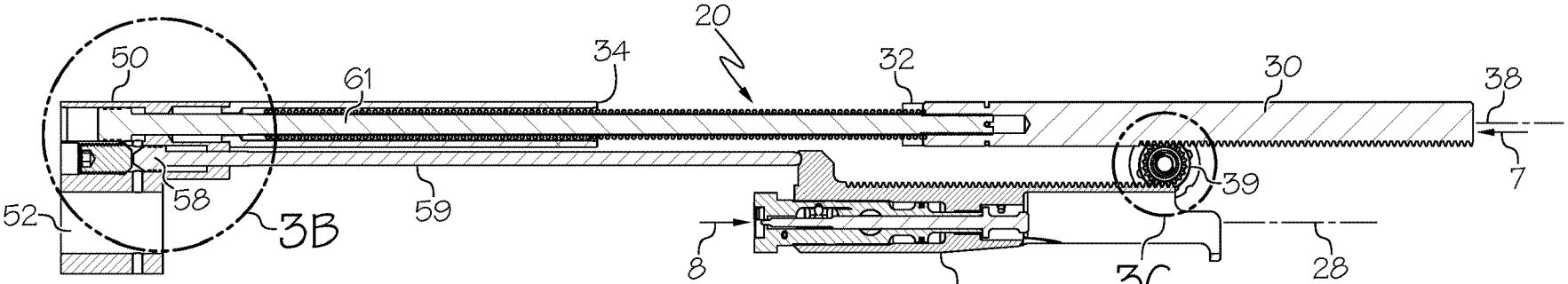
FIGS. 3A-3C show cross-sectional views of the embodiment of an action mechanism shown in FIG. 2 in a first orientation.
Figure 3C:
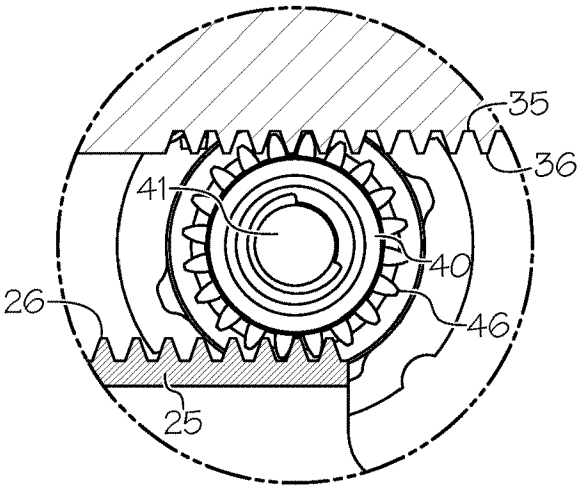
Figure 3B:
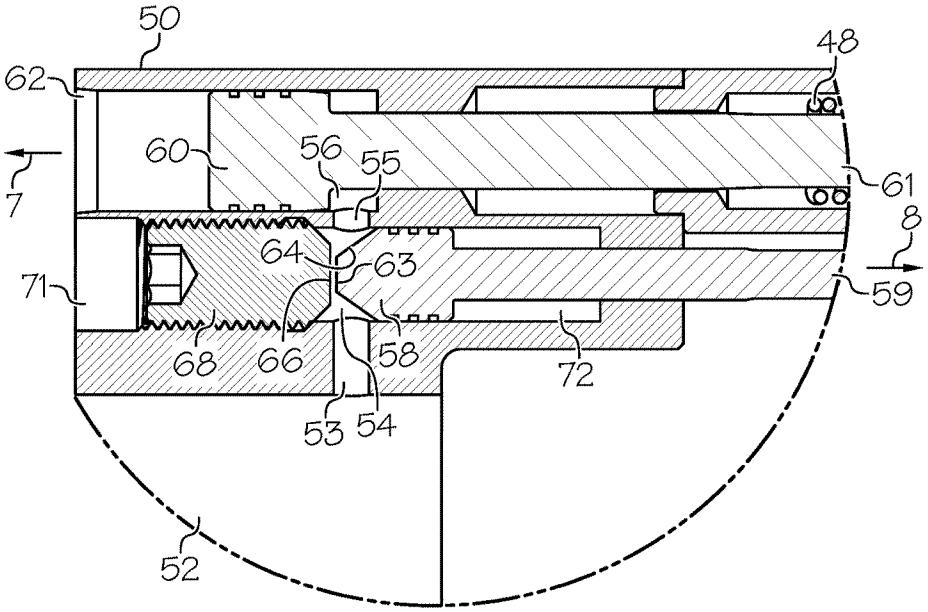

FIG. 2 shows some components of the embodiment of the firearm 10 shown in FIG. 1, illustrating embodiments of some parts contained within the housing 12. FIGS. 3A-3C show cross-sectional views of the embodiments of components shown in FIG. 2.

Referring to FIGS. 1-3C, in some embodiments, an action mechanism 20 comprises a bolt assembly 22 arranged to travel within the housing 12. In some embodiments, the action mechanism 20 comprises a counterweight 30. In some embodiments, the counterweight 30 is arranged to move opposite the movement of the bolt assembly 22. In some embodiments, the counterweight 30 is arranged to move equal but opposite to the movement of the bolt assembly 22. In some embodiments, the action mechanism 20 comprises a connector 39 engaged with the bolt assembly 22 and with the counterweight 30.

In some embodiments, the bolt assembly 22 is arranged to move along a first axis 28. In some embodiments, the first axis 28 is parallel to a shooting axis of the firearm 10. In some embodiments, the counterweight 30 is arranged to move along a second axis 38. In some embodiments, the second axis 38 is parallel to the first axis 28.

In some embodiments, the action mechanism 20 comprises a connector 39 engaged with the bolt assembly 22. In some embodiments, the connector 39 is supported by the housing 12. In some embodiments, the connector 39 comprises a roller 40 arranged to rotate about an axis 41. In some embodiments, the axis 41 is orthogonal to the first axis 28. In some embodiments, the roller 40 is engaged with the counterweight 30. In some embodiments, the roller 40 comprises teeth 46. In some embodiments, the roller 40 comprises a spur gear. In some embodiments, the bolt assembly 22 comprises teeth 26 engaged with the roller teeth 46. In some embodiments, the teeth 26 of the bolt assembly 22 comprise a first rack 25. In some embodiments, counterweight 30 comprises teeth 36 engaged with the roller teeth 46. In some embodiments, the teeth 36 of the counterweight 30 comprise a second rack 35.

In some embodiments, the first rack 25 and the roller 40 comprise a first rack and pinion, and the second rack 35 and the roller 40 comprise a second rack and pinion. In some embodiments, the first rack 25 is arranged to move equal but opposite to the second rack 35.

In some embodiments, an action mechanism 20 comprises a recoil spring 48 arranged to provide a force that will bias the bolt assembly 22 to a battery position. In some embodiments, the recoil spring 48 is offset from the first axis 28. In some embodiments, the recoil spring 48 is aligned upon the second axis 38. In some embodiments, the recoil spring 48 is arranged to apply a force to the counterweight 30.

In some embodiments, an action mechanism 20 is arranged to use expanding propellant gas provided by a fired round to cycle the action mechanism 20.

In some embodiments, an action mechanism 20 comprises a gas block 50. In some embodiments, a gas block 50 is attached to a barrel 18 of the firearm 10. In some embodiments, the gas block 50 comprises a barrel cavity 52 arranged to receive the barrel 18. In some embodiments, the gas block 50 surrounds the barrel 18. Desirably, the gas block 50 comprises a fluid passageway 53 in fluid communication with an interior portion of the barrel 18. In some embodiments, the gas block 50 comprises a first cavity 54 in fluid communication with the fluid passageway 53. In some embodiments, the action mechanism 20 is arranged to use pressurized fluid in the first cavity 54 to apply a force to the bolt assembly 22 that moves the bolt assembly 22, for example in a rearward direction 8.

In some embodiments, the action mechanism 20 comprises a first piston 58. In some embodiments, the first cavity 54 of the gas block 50 comprises a cylinder and the first piston 58 is arranged to move back and forth in the first cavity 54. In some embodiments, pressurized gas entering the first cavity 54 will bias and move the first piston 58. In some embodiments, the first piston 58 is arranged to apply a force to the bolt assembly 22 that moves the bolt assembly 22 to cycle the action mechanism 20. In some embodiments, the first piston 58 comprises a first connecting rod 59 arranged to contact the bolt assembly 22. In some embodiments, the first connecting rod 59 is supported near a first end by the gas block 50 and is supported near a second end by the receiver 12.

In some embodiments, the gas block 50 comprises a first stop 66 arranged to limit travel of the first piston 58, for example in a forward direction 7.

In some embodiments, the gas block 50 comprises a plug 68. In some embodiments, the plug 68 is oriented in the first cavity 54. In some embodiments, the plug 58 comprises the first stop 66. In some embodiments, the first cavity 54 comprises a first portion 71 and a second portion 72. In some embodiments, the second portion 72 comprises a cylinder and the first piston 58 is oriented in the second portion 72. In some embodiments, the first portion 71 is larger in size than the second portion 72. In some embodiments, the first portion 71 comprises a larger diameter than the second portion 72. In some embodiments, the plug 68 is received in the first portion 71. In some embodiments, the plug 68 is attached to the first portion 71, for example with screw threads. In some embodiments, a size of the first portion 71 is larger than a size of the first piston 58, allowing the first piston 58 to be removed via the first portion 71 of the first cavity 54 when the plug 68 is removed. In some embodiments, the first piston 58 comprises a first end 63 arranged to contact the first stop 66. In some embodiments, the first piston 58 is reduced in cross-section near the first end 63. In some embodiments, the first piston 58 comprises a taper 64. In some embodiments, the first piston 63 comprises a frustoconical portion, a curved or rounded portion, or any other suitable shape that reduces the cross-sectional size of the piston 58 near the first end 63.

In some embodiments, an action mechanism 20 is arranged to use expanding propellant gas provided by a fired round to apply a force to a counterweight 30. In some embodiments, expanding propellant gas biases the counterweight 30 to move in a direction opposite movement of the bolt assembly 22.

In some embodiments, the gas block 50 comprises a second cavity 56. In some embodiments, the second cavity 56 is in fluid communication with an interior portion of the barrel 18. In some embodiments, the second cavity 56 is in fluid communication with the fluid passageway 53. In some embodiments, the second cavity 56 is in fluid communication with the first cavity 54. In some embodiments, the gas block 50 comprises a fluid passageway 55 between the first cavity 54 and the second cavity 56. In some embodiments, the action mechanism 20 comprises a second piston 60. In some embodiments, the second piston 60 is attached to the counterweight 30. In some embodiments, a second connecting rod 61 extends between the second piston 60 and the counterweight 30. In some embodiments, the second piston 60 is arranged to move along the second axis 38. In some embodiments, the second cavity 56 comprises a cylinder and the second piston 60 is arranged to move back and forth in the second cavity 56. In some embodiments, pressurized gas entering the second cavity 56 will bias and move the second piston 60. In some embodiments, the second piston 60 is arranged to apply a force to the counterweight 30 that moves the counterweight in a way that is complimentary to movement of the bolt assembly 22.

In some embodiments, an action mechanism 20 comprises a first piston 58 and a second piston 60 offset from the first piston 58. In some embodiments, the first piston 58 is arranged to initially move in a first direction 8 as the action mechanism cycles. In some embodiments, the second piston 60 is arranged to initially move in a second direction 7 as the action mechanism 20 cycles. In some embodiments, the first direction 8 is different from the second direction 7. In some embodiments, the first direction 8 is opposite the second direction 7. In some embodiments, the first direction 8 comprises a rearward direction (e.g. opposite a shooting vector of the firearm) and the second direction 7 comprises a forward direction.

Referring to FIGS. 3A-3C, in some embodiments, a cycling operation is initiated by fluid pressure entering the fluid passageway 53. As the fluid pressurizes the first cavity 54, it moves the first piston 58 in a first direction 8, which in turn moves the bolt assembly 22 in the first direction 8. In some embodiments, the first piston 58 comprises a shape arranged to allow fluid pressure to reach the second cavity 56, such as a taper 64. As the fluid pressurizes the second cavity 56, it moves the second piston 60 in a second direction 7. In some embodiments, the second piston 60 is engaged with a counterweight 30 and the counterweight moves in the second direction 7.

In some embodiments, the second cavity 56 comprises an aperture 62 in fluid communication with the outside environment. In some embodiments, the aperture 62 comprises an open end of the second cavity 56. In some embodiments, pressurized fluid enters the second cavity 56 to a first side of the second piston 60, for example via a fluid passageway 55 within the gas block 50. In some embodiments, the aperture 62 is located to a second side of the second piston 60. In some embodiments, as the second piston 60 moves in the second direction 7, it exits the second cavity 56 via the aperture 62.

Figure 4A:
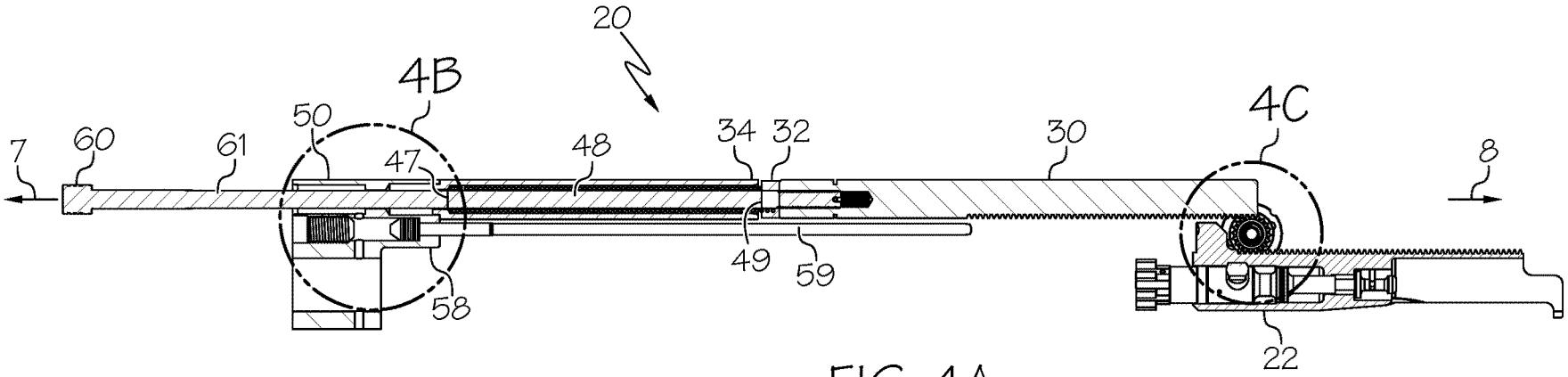
FIGS. 4A-4C show cross-sectional views of the embodiment of an action mechanism shown in FIG. 2 in a second orientation.
Figure 4C:
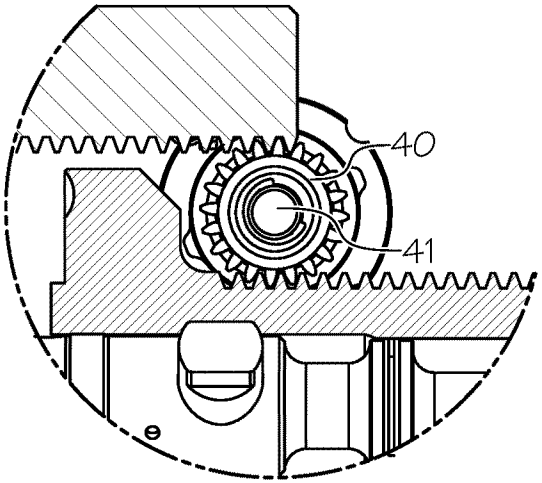
Figure 4B:
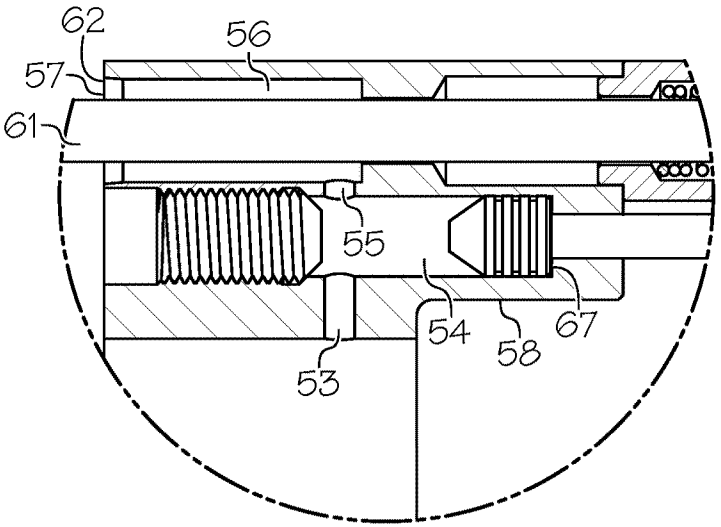

FIGS. 4A-4C show the embodiment of FIGS. 3A-3C at another stage of a cycling operation. In some embodiments, FIGS. 4A-4C represent an end of the initial travel of components due to pressurized fluid from the gas block 50, where the components reverse their travel and return to a battery orientation, for example under force provided by a recoil spring 48.

In some embodiments, the gas block 50 comprises a backstop 67 arranged to limit travel of the first piston 58. In some embodiments, an end wall of the first cavity 54 comprises the backstop 67.

In some embodiments, the gas block 50 comprises a vent 57 arranged to vent pressurized fluid to the outside environment. In some embodiments, the vent 57 is in fluid communication with the fluid passageway 53 in some orientations, but not others. In some embodiments, the vent 57 is not in fluid communication with the fluid passageway 53 when the action mechanism 20 is in battery. In some embodiments, the vent 57 is in fluid communication with the fluid passageway 53 only while the action mechanism is cycling.

In some embodiments, the second piston 60 is arranged to exit the second cavity 56 of the gas block 50. In some embodiments, after the second piston 60 passes through the aperture 62, the aperture 62 provides fluid communication between the outside environment and the cavities 54, 56 of the gas block 50, and the aperture comprises a vent 57.

In some embodiments, the second piston 60 and counterweight 30 move in the second direction 7 under force provided by propellant gas. In some embodiments, the counterweight 30 is also biased in the second direction 7 due to force from the roller and engagement between the bolt assembly 22 and the counterweight 30, due to movement of the bolt assembly 22. In some embodiments, movement of the counterweight 30 in the second direction 7 will apply forces to a recoil spring 48. In some embodiments, movement of the counterweight 30 in the second direction 7 will compress the recoil spring 48. In some embodiments, a first end 47 of the recoil spring 48 is oriented near the gas block 50. In some embodiments, the first end 47 remains oriented near the gas block 50 as the action mechanism 20 cycles. In some embodiments, a second end 49 of the recoil spring 48 moves as the action mechanism 20 cycles. In some embodiments, the second end 49 moves in the second direction 7 as the recoil spring 48 is compressed.

In some embodiments, the counterweight 30 will reach an end of travel, for example as shown in FIG. 4A. In some embodiments, the action mechanism 20 comprises a recoil stop 34 arranged to limit travel of the counterweight 30. In some embodiments, a bumper 32 is oriented between the counterweight 30 and the recoil stop 34. In some embodiments, force provided by the recoil spring 48 will bias the counterweight 30 in the first direction and return the counterweight 30 to its battery position. In some embodiments, the movement of the counterweight 30 will rotate the roller 40 and return the bolt assembly 22 to its battery position.

In some embodiments, the recoil spring 48 comprises a tubular coil. In some embodiments, the recoil spring 48 is supported by the second connecting rod 61. In some embodiments, second connecting rod 61 extends through the recoil spring 48, and the recoil spring 48 surrounds the second connecting rod 61. In some embodiments, a bumper 32 is supported by the second connecting rod 61. In some embodiments, the bumper 32 comprises a tubular shape and surrounds the second connecting rod 61. In some embodiments, the bumper 32 contacts the counterweight 30. In some embodiments, the recoil stop 34 is attached to the gas block 50. In some embodiments, the recoil stop 34 comprises a tube. In some embodiments, the recoil stop 34 surrounds the second connecting rod 61. In some embodiments, the recoil stop 34 surrounds the recoil spring 48. In some embodiments, the first end 47 of the recoil spring 48 contacts the recoil stop 34. In some embodiments, the first end 47 of the recoil spring 48 contacts the gas block 50.

Figure 5A:
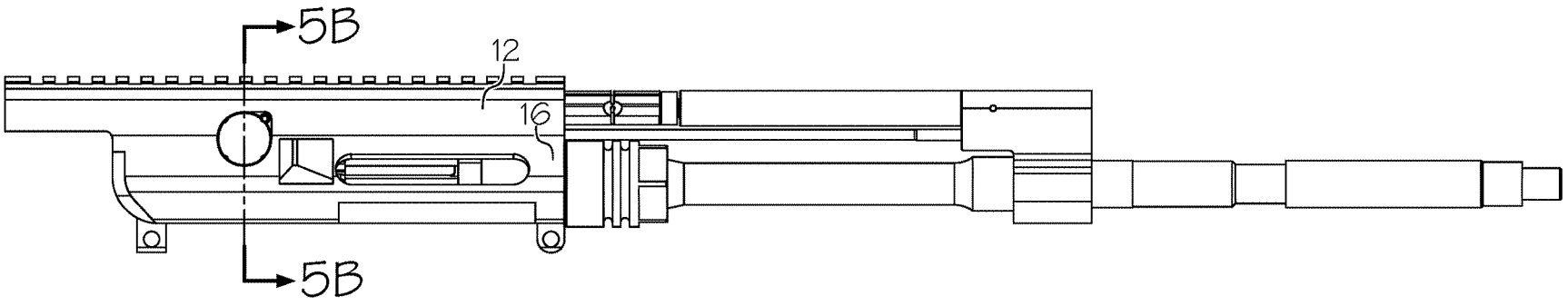
FIGS. 5A-5C show views of an embodiment of an action mechanism and an embodiment of an upper receiver.
Figure 5C:
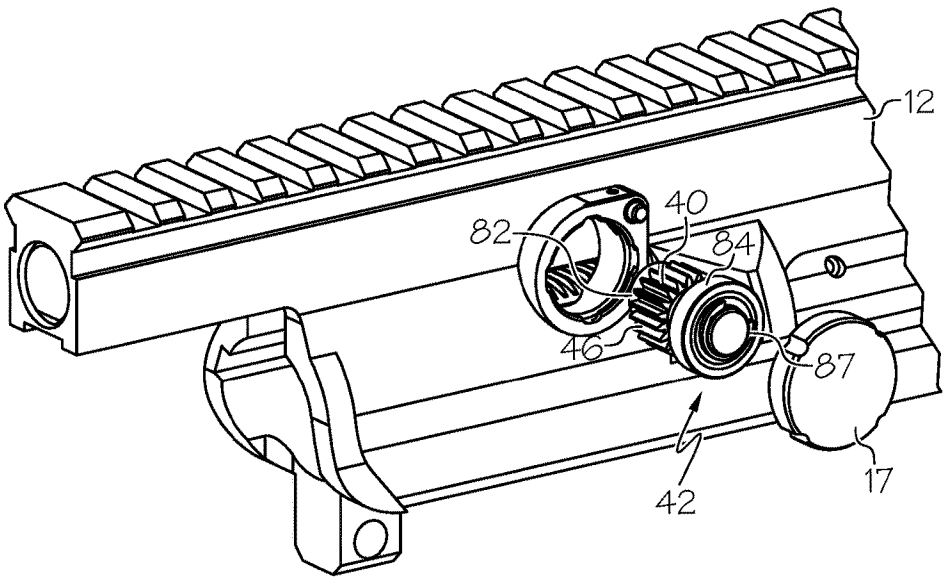
Figure 5B:
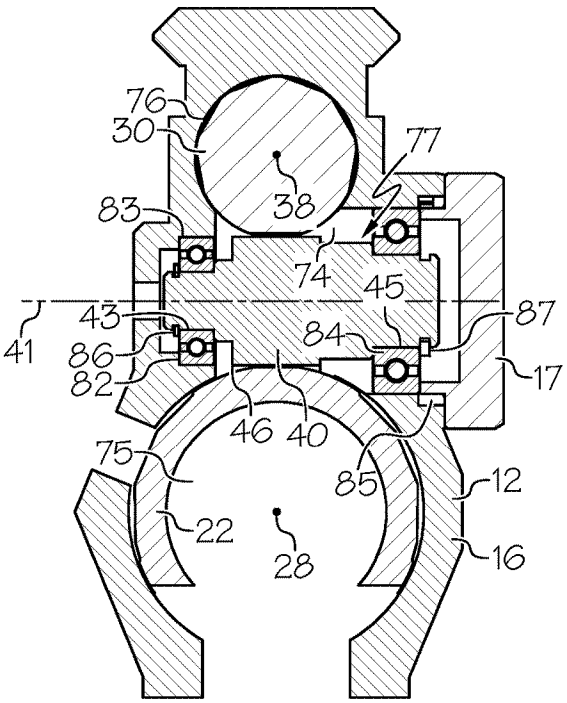

FIGS. 5A-5C show views of embodiments of parts as described herein, and a view showing servicing of a gear assembly 42 comprising a roller 40. In some embodiments, a housing 12 comprises an internal cavity 74. In some embodiments, the housing 12 comprises a servicing aperture and a cover 17 arranged to close the servicing aperture. In some embodiments, removing the cover 74 provides access to the internal cavity 74 via the servicing aperture. In some embodiments, the cavity 74 comprises a first portion 75 and the bolt assembly 22 is oriented in the first portion 75. In some embodiments, one or more wall portions of the receiver 12 defining the first portion 75 comprise guides arranged to guide travel of the bolt assembly 22 along the first axis 28. In some embodiments, the cavity 74 comprises a second portion 76 and the counterweight 30 is oriented in the second portion 74. In some embodiments, one or more wall portions of the receiver 12 defining the second portion 76 comprise guides arranged to guide travel of the counterweight 30 along the second axis 38. In some embodiments, the cavity 74 comprises a third portion 77 and the roller 40 is oriented in the third portion 77.

In some embodiments, the housing 12 supports a roller assembly 42. In some embodiments, a roller assembly 42 comprises a roller 40 and a bearing 82. In some embodiments, the bearing 82 comprises a roller bearing, for example having an inner race in contact with the roller 40 and an outer race in contact with the housing 12. In some embodiments, the roller assembly 42 comprises a second bearing 84. In some embodiments, the roller 40 comprises a first journal 43 and a second journal 45. In some embodiments, the roller 40 comprises gear teeth 46 located between the first journal 43 and the second journal 45. In some embodiments, the gear teeth 46 are located between the first bearing 82 and the second bearing 84.

In some embodiments, the first bearing 82 comprises a different size than the second bearing 84. In some embodiments, the second bearing 84 comprises a larger diameter than the first bearing 82. In some embodiments, the first journal 43 comprises a different size than the second journal 45. In some embodiments, the second journal 45 comprises a larger diameter than the first journal 43.

In some embodiments, the receiver 12 comprises a first seat 83 arranged to receive the first bearing 82. In some embodiments, the receiver 12 comprises a second seat 85 arranged to receive the second bearing 84.

In some embodiments, the cover 17 contacts a bearing 82, 84. In some embodiments, the cover 17 contacts the second bearing 84. In some embodiments, a housing 12 body portion comprises a first portion of the second seat 85 and the cover 17 comprises a second portion of the second seat 85.

In some embodiments, a roller assembly 42 comprises a fastener 86 arranged to retain a bearing 82. In some embodiments, the roller assembly 42 comprises a first fastener 86 arranged to retain the first bearing 82 and a second fastener 87 arranged to retain the second bearing 84. In some embodiments, a fastener 86, 87 comprises a spring clip that is received in a groove in the roller. In some embodiments, a first fastener 86 comprises a different size than a second fastener 87. In some embodiments, a first groove that receives the first fastener 86 is sized differently from a second groove that receives the second fastener 87.

Figure 6A:
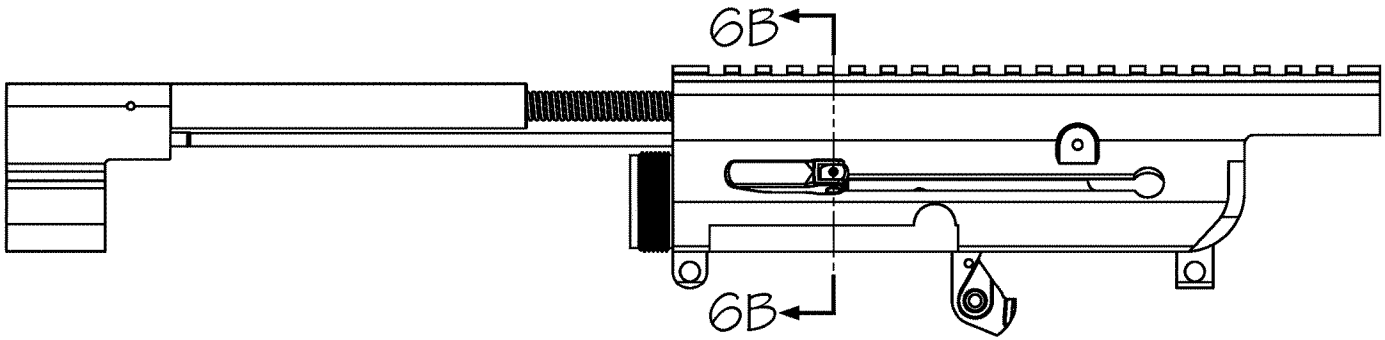
FIGS. 6A-6C show views an embodiment of a bolt assembly and an embodiment of a housing.
Figure 6B:
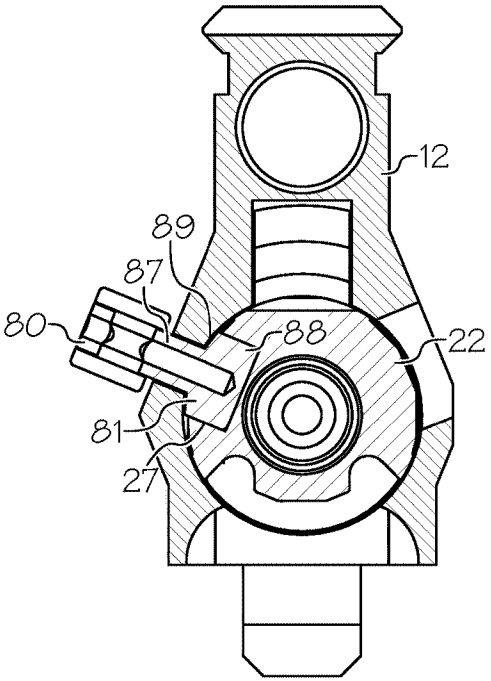
Figure 6C:
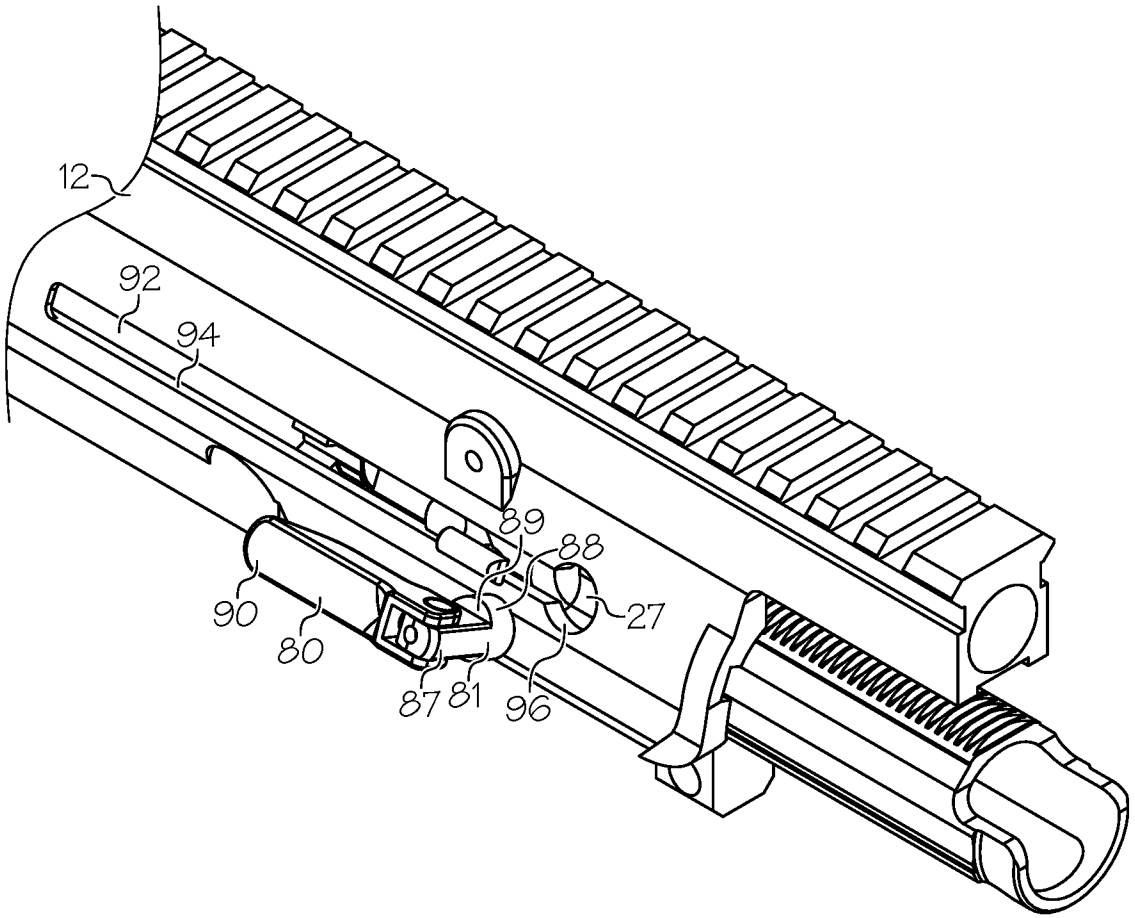

FIGS. 6A-6C show an embodiment of a housing 12 and an embodiment of a bolt assembly 22 comprising a charging handle 80. In some embodiments, a charging handle 80 allows a user to manually move the bolt assembly 22.

In some embodiments, a bolt assembly 22 comprises a cavity 27 arranged to receive a charging handle 80. In some embodiments, a charging handle 80 comprises a stem 81 that is received in the cavity 27 and extends through the receiver 12. In some embodiments, the receiver 12 comprises a slot 92. In some embodiments, the charging handle 80 is arranged to traverse back and forth in the slot 92 as the bolt assembly 22 moves.

In some embodiments, the slot 92 comprises a first portion 94 and a second portion 96. In some embodiments, the first portion 94 is shaped differently from the second portion 96. In some embodiments, the first portion 94 comprises a linear slot, for example comprising parallel walls. In some embodiments, the second portion 96 is larger than the first portion 94. In some embodiments, the second portion 96 comprises a circular shape. In some embodiments, a shape of the second portion 96 is similar to a cross-sectional shape of the cavity 27 of the bolt assembly 22.

In some embodiments, the stem 81 of the charging handle 80 comprises a first portion 87 and a second portion 88. In some embodiments, the second portion 88 is larger than the first portion 87. In some embodiments, the second portion 88 comprises a flange 89. In some embodiments, a cross-sectional shape of the second portion 88 is similar to a cross-sectional shape of the cavity 27 of the bolt assembly 22. In some embodiments, the second portion 88 of the charging handle 80 is able to pass through the second portion 96 of the slot 92 of the housing 12, but the second portion 88 is not able to pass through the first portion 94 of the slot 92. In some embodiments, when the cavity 27 is aligned with the second portion 96 of the slot 92, the charging handle 80 can be installed or removed. In some embodiments, the cavity 27 is aligned with the second portion 96 of the slot 92 when the bolt assembly 22 is positioned in a servicing orientation with respect to the receiver 12. In some embodiments, the bolt assembly 27 does not assume the servicing orientation during any portion of a normal cycling operation. In some embodiments, the first portion 87 of the stem 81 is sized to move along a length of the first portion 94 of the slot 92. Thus, the charging handle 80 can be installed from a servicing orientation, for example as shown in FIG. 6C, wherein the second portion 88 of the stem 81 is received in the cavity 27. In some embodiments, the bolt assembly 22 can be moved to a normal operating orientation, which moves the stem 81 into the first portion 94 of the slot 92. In some embodiments, the second portion 88 remains in the cavity 27 and moves with the bolt assembly 22. In some embodiments, the second portion 88 prevents the charging handle 80 from disengaging the bolt assembly 22, for example via the flange 89 abutting an inner surface of the housing 12.

In some embodiments, the charging handle 80 locks the bolt assembly 22 into the receiver 12.

In some embodiments, the stem 81 of the charging handle 80 is retained by the receiver 12 and the charging handle 80 is not fixedly attached to the bolt assembly 22. For example, in some embodiments, the connection between the charging handle 80 and bolt assembly 22 excludes any screws or other traditional fastening members.

In some embodiments, the charging handle 80 comprises a body 90 that is moveable with respect to the stem 81. In some embodiments, the body 90 is attached to the stem 81 via a hinge.

Figure 7A:
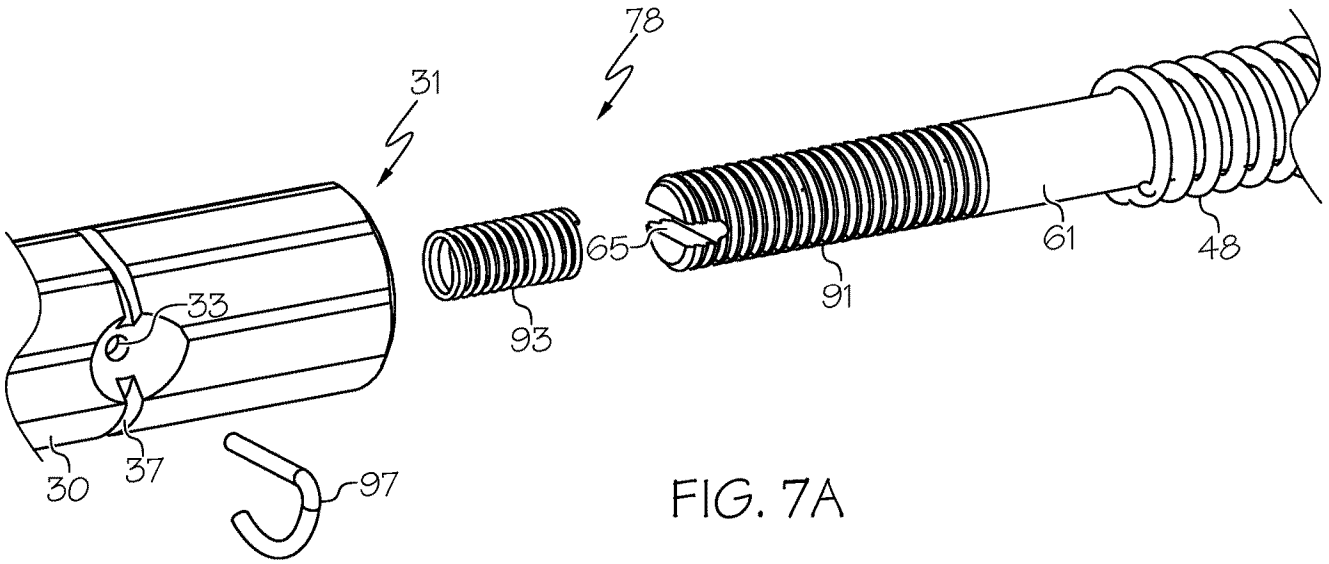
FIGS. 7A and 7B show an embodiment of a connection with an embodiment of a counterweight.
Figure 7B:
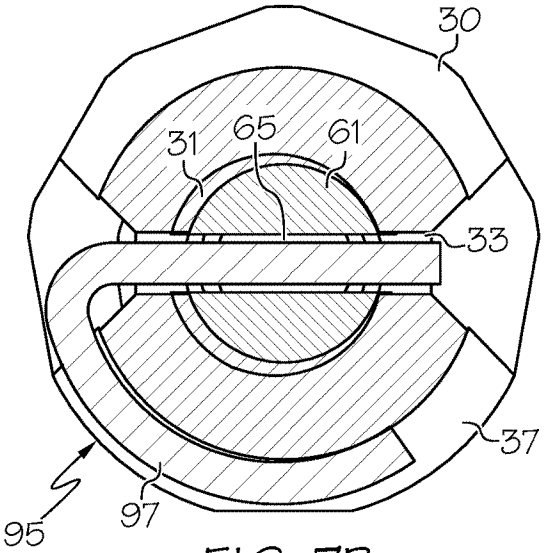

FIGS. 7A and 7B show an embodiment of a connection 78 between an embodiment of a counterweight 30 and an embodiment of a connecting rod 61. In some embodiments, the connection 78 comprises an adjustment mechanism allowing adjustment of the specific length of the components. In some embodiments, the connecting rod 61 comprises screw threads 91. In some embodiments, the counterweight 30 comprises a cavity 31 arranged to receive the connecting rod 61. In some embodiments, the cavity 31 comprises threads arranged to engage the screw threads 91. In some embodiments, the threaded engagement between the counterweight and connecting rod 61 allows for fine adjustment of the specific length of the assembly. In some embodiments, for example when the connecting rod 61 is attached to a piston 60, the screw threads 91 allow for fine adjustment of the piston 60 position with respect to a cavity 56.

In some embodiments, a spring 93 is positioned in the cavity 31 between the counterweight 30 and the connecting rod 61. In some embodiments, the spring 93 held under compression between the counterweight 30 and the connecting rod 61.

In some embodiments, the connection 78 comprises a locking mechanism 95 arranged to lock the connecting rod 61 to the counterweight 30. In some embodiments, the counterweight 30 comprises an aperture 33 extending through sidewall portions that define the cavity 31. In some embodiments, the counterweight 30 comprises a groove 37, for example formed in an external sidewall. In some embodiments, the groove 37 is aligned with the aperture 33. In some embodiments, the locking mechanism 95 comprises a spring clip 97. In some embodiments, the spring clip 97 comprises a first portion extending through the aperture 33 and across the cavity 31 and a second portion oriented in the groove 37. In some embodiments, the connecting rod 61 is arranged to receive the first portion of the spring clip 97. In some embodiments, the connecting rod 61 comprises a slot 65, and the first portion of the spring clip 97 is oriented in the slot 65 when the lock mechanism 95 is engaged. In some embodiments, the spring clip 97 interferes with rotation of the connecting rod 61 with respect to the counterweight 30, and thereby prevents disengagement of the connecting rod 61 from the counterweight 30.

In some embodiments, a bolt assembly 22 comprises a firing pin. In some embodiments, a bolt assembly 22 as described herein comprises a separate bolt and bolt carrier. In some embodiments, a bolt is arranged to rotate with respect to the bolt carrier and to lock into a breech. In some embodiments, a bolt assembly 22 does not include a rotating bolt. In some embodiments, a bolt assembly 22 is compatible with AR9 and pistol caliber carbide (PCC) designs.

In some embodiments, a moving mass of a counterweight assembly is generally equal to a moving mass of a bolt assembly. In some embodiments, a counterweight assembly comprises a counterweight 30 and all other parts attached to the counterweight 30 that move with the counterweight 30 as the action mechanism 20 cycles. In some embodiments, a counterweight assembly comprises the second piston 60 and second connecting rod 61. In some embodiments, a counterweight assembly comprises a bumper 32. In some embodiments, a bolt assembly 22 comprises a bolt and all other parts attached to the bolt that move with the bolt as the action mechanism 20 cycles. In some embodiments, a bolt assembly 22 comprises a firing pin. In some embodiments, a bolt assembly 22 comprises a bolt carrier.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm action mechanism comprising:

a barrel comprising an internal cavity;

a bolt assembly arranged to move along a first axis;

a counterweight arranged to move along a second axis;

a connector engaged with the bolt assembly and with the counterweight; and a gas block comprising a fluid passageway in fluid communication with the internal cavity, the fluid passageway comprising a first portion and a second portion, the first portion arranged to apply a first force to the bolt assembly in a first direction, the second portion arranged to apply a second force to the counterweight in a second direction;

wherein a direction of movement of the bolt assembly is different from a direction of movement of the counterweight.

2. The firearm action mechanism of claim 1, wherein the first axis is parallel to the second axis.

3. The firearm action mechanism of claim 1, the connector comprising a roller.

4. The firearm action mechanism of claim 1, the connector comprising a gear.

5. The firearm action mechanism of claim 4, the bolt assembly comprising a first rack engaged with the gear.

6. The firearm action mechanism of claim 5, the counterweight comprising a second rack engaged with the gear.

7. The firearm action mechanism of claim 1, the counterweight arranged to move between a first position and a second position, the counterweight comprising a recoil spring arranged to bias the counterweight to the first position.

8. The firearm action mechanism of claim 1, comprising a first piston oriented in the first portion, the first piston applying the first force to the bolt assembly.

9. The firearm action mechanism of claim 8, comprising a second piston oriented in the second portion, the second piston applying the second force to the counterweight.

10. A firearm comprising:

a barrel comprising an internal cavity;

a housing comprising a first guide and a second guide;

a bolt assembly arranged to move in the first guide;

a counterweight arranged to move in the second guide; and a connector engaged with the bolt assembly and with the counterweight; and a gas block comprising a fluid passageway in fluid communication with the internal cavity, the fluid passageway comprising a first portion and a second portion, the first portion arranged to apply a first force to the bolt assembly in a first direction, the second portion arranged to apply a second force to the counterweight in a second direction;

wherein a direction of movement of the bolt assembly is different from a direction of movement of the counterweight.

11. The firearm of claim 10, the housing comprising a cavity comprising a first cavity portion, a second cavity portion and a third cavity portion, the first cavity portion comprising the first guide, the second cavity portion comprising the second guide, the connector oriented in the third cavity portion.

12. The firearm of claim 11, the housing comprising a servicing aperture and a cover, the servicing aperture in fluid communication with the third cavity portion, the cover arranged to close the servicing aperture.

13. The firearm of claim 12, wherein the connector is sized to pass through the servicing aperture.

14. The firearm of claim 10, the connector arranged to rotate with respect to the housing.

15. The firearm of claim 10, the counterweight arranged to move between a first position and a second position, the counterweight comprising a recoil spring arranged to bias the counterweight to the first position.

16. The firearm of claim 10, comprising a first piston oriented in the first portion, the first piston applying the first force to the bolt assembly.

17. The firearm of claim 16, comprising a second piston oriented in the second portion, the second piston applying the second force to the counterweight.

18. A firearm comprising:

a barrel comprising an internal cavity; and a gas block comprising a fluid passageway in fluid communication with the internal cavity, the fluid passageway comprising a first cylinder and a second cylinder, the first cylinder arranged to apply a first force to a first piston in a first direction, the second cylinder arranged to apply a second force to a second piston in a second direction, the first direction opposite the second direction.

19. The firearm of claim 18, wherein a central axis of the first cylinder is offset from a central axis of the second cylinder.

* * * * *